US008397458B2

(12) United States Patent
Tedesco et al.

(10) Patent No.: US 8,397,458 B2
(45) Date of Patent: Mar. 19, 2013

(54) BRACKET USEFUL WITH SLOPED SUSPENDED CEILING SYSTEMS

(75) Inventors: Lee M. Tedesco, Shorewood, IL (US); James J. Lehane, Jr., McHenry, IL (US); Abraham M. Underkofler, Waukegan, IL (US); Mark R. Paulsen, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 437 days.

(21) Appl. No.: 12/644,034

(22) Filed: Dec. 22, 2009

(65) Prior Publication Data

US 2011/0078969 A1 Apr. 7, 2011

Related U.S. Application Data

(60) Provisional application No. 61/247,744, filed on Oct. 1, 2009.

(51) Int. Cl.
*E04B 9/34* (2006.01)

(52) U.S. Cl. ..... 52/506.05; 52/506.08; 52/98

(58) Field of Classification Search .. 52/506.05–506.08, 52/98, 712

See application file for complete search history.

(56) References Cited

U.S. PATENT DOCUMENTS

| | | | | | |
|---|---|---|---|---|---|
| 2,221,854 | A | * | 11/1940 | Zalkind | 52/100 |
| 2,255,321 | A | * | 9/1941 | Kress | 403/230 |
| 2,971,737 | A | * | 2/1961 | Parker | 248/205.1 |
| 3,939,549 | A | * | 2/1976 | Masengill, Sr. | 29/432 |
| 4,660,348 | A | * | 4/1987 | LaLonde | 52/506.08 |
| 5,056,747 | A | * | 10/1991 | Kireta | 248/231.81 |
| D371,506 | S | * | 7/1996 | Nofziger | D8/354 |
| 6,018,923 | A | * | 2/2000 | Wendt | 52/712 |
| 6,138,425 | A | * | 10/2000 | Wendt | 52/506.07 |
| 6,205,733 | B1 | * | 3/2001 | LaLonde | 52/506.07 |
| 7,134,249 | B2 | * | 11/2006 | Shapiro et al. | 52/311.2 |
| 7,293,393 | B2 | * | 11/2007 | Kelly et al. | 52/665 |
| 7,552,567 | B2 | * | 6/2009 | Ingratta et al. | 52/506.07 |

(Continued)

FOREIGN PATENT DOCUMENTS

| | | | |
|---|---|---|---|
| EP | 0417762 | A1 | 3/1991 |
| EP | 1775398 | A2 | 4/2007 |

(Continued)

OTHER PUBLICATIONS

Written Opinion of the International Searching Authority, International Search Report dated Jun. 16, 2011 for corresponding PCT/US2010/051027, filed Oct. 1, 2010.

(Continued)

*Primary Examiner* — Joshua J Michener
*Assistant Examiner* — Elizabeth A Plummer
(74) *Attorney, Agent, or Firm* — Pearne & Gordon LLP

(57) ABSTRACT

The invention provides a bracket and method of its use for adapting standard wall angle trim for use in sloped ceiling construction. The disclosed bracket arrangement can be used for the top edge or bottom edge of a sloped ceiling and be adjusted to match the angle of any practical ceiling slope. In disclosed embodiments, the bracket has the form of a rectangular flat steel sheet. The sheet has a hinge or bend line running lengthwise in its mid-area. The bend line is made by cutting the sheet intermittently along its length and thereby dividing the sheet into two sections. The cuts may be made, for example, by punching elongated slots along the bend line in a blank being formed into the bracket. Also punched into the bracket blank are a plurality of holes distributed lengthwise on marginal areas of the two sections of the blank.

6 Claims, 3 Drawing Sheets

U.S. PATENT DOCUMENTS

| | | | | |
|---|---|---|---|---|
| 7,631,463 | B2 * | 12/2009 | Greenlee et al. | 52/182 |
| D626,406 | S * | 11/2010 | Tedesco et al. | D8/394 |
| D626,407 | S * | 11/2010 | Tedesco et al. | D8/394 |
| D637,897 | S * | 5/2011 | Tedesco et al. | D8/394 |
| 2006/0059845 | A1 * | 3/2006 | Visone | 52/702 |
| 2006/0096219 | A1 * | 5/2006 | Ingratta et al. | 52/506.07 |
| 2011/0283634 | A1 * | 11/2011 | Underkofler et al. | 52/167.1 |

FOREIGN PATENT DOCUMENTS

| | | | |
|---|---|---|---|
| FR | 2627527 | A1 * | 8/1989 |
| JP | 11-256754 | A | 9/1999 |
| KR | 20-1998-0008335 | U | 4/1998 |
| KR | 20-2009-0000308 | U | 1/2009 |

OTHER PUBLICATIONS

U.S. Appl. No. 29/299,675, filed Jan. 1, 2008, James J. Lehane, "Perimeter Clip Useful for Ceiling Grid Systems".

* cited by examiner

FIG. 3
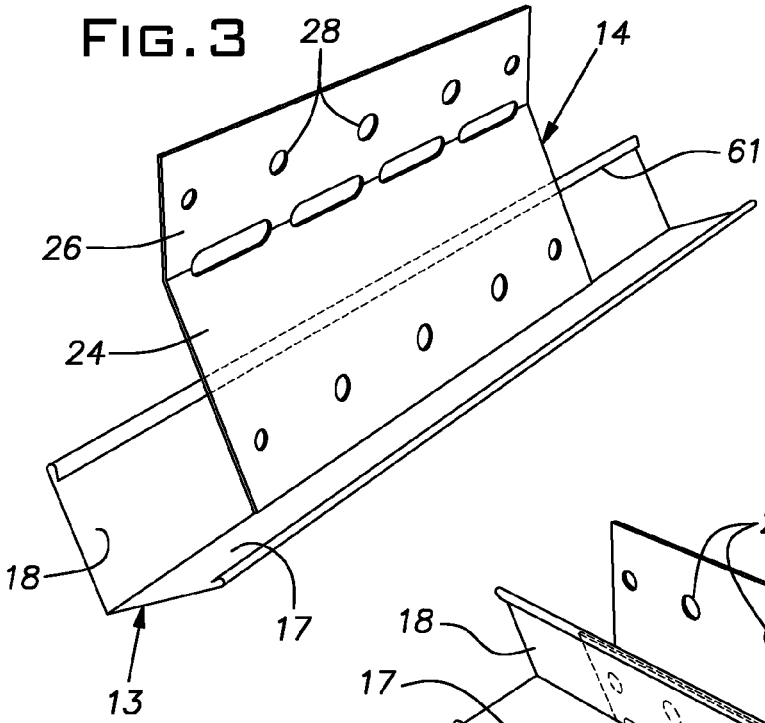
FIG. 4
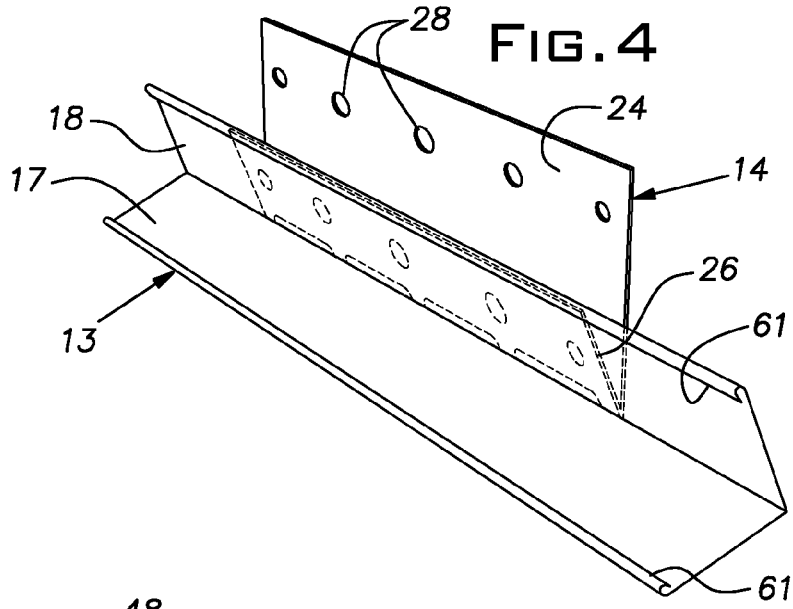
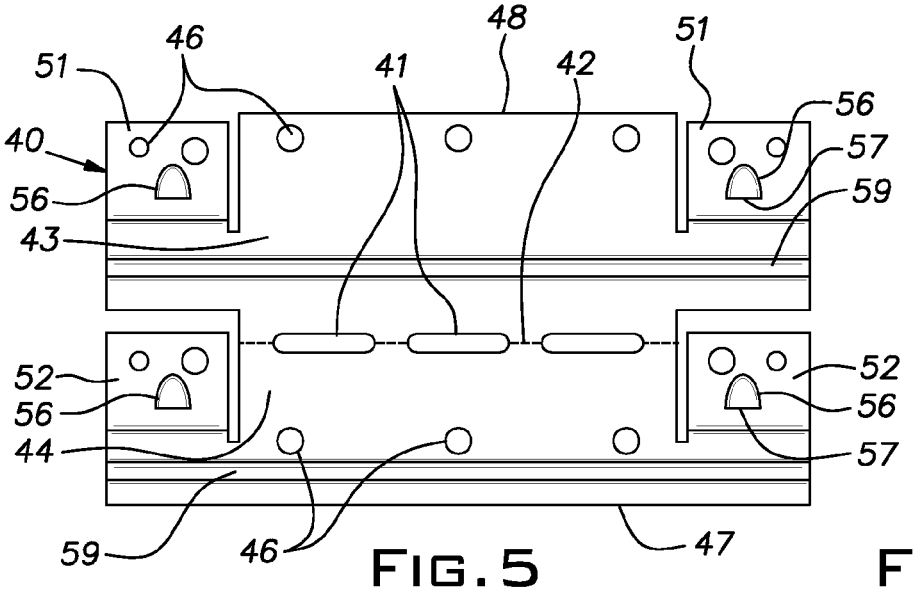
FIG. 5
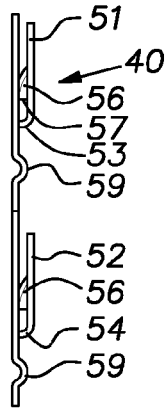
FIG. 6

BRACKET USEFUL WITH SLOPED SUSPENDED CEILING SYSTEMS

This application claims the priority of U.S. Provisional Application No. 61/247,744, filed Oct. 1, 2009.

BACKGROUND OF THE INVENTION

The invention relates to suspended ceiling construction and, in particular, to accessories for constructing sloped suspended ceilings.

PRIOR ART

Suspended ceilings are widely used in commercial buildings because of their versatility and economy. Ordinarily, these ceilings comprise a rectangular grid made up of parallel main tees and intersecting cross tees and panels or tiles assembled in the spaces between the tees. Where the ceilings meet the walls, the ends of the tees are typically supported by elongated wall angles. The wall angle, ordinarily of roll formed sheet metal, has a horizontal exposed leg or face typically with an appearance harmonious in scale with the faces of the tees. Besides supporting the tee ends, the horizontal leg serves to conceal them for a finished appearance. A wall angle is usually fixed to a wall with longitudinally spaced fasteners driven through its vertical leg. The vertical leg and fasteners are concealed from view when the ceiling panels are thereafter installed.

Sloped ceilings are used to obtain different architectural effects and can be used to improve day lighting and contribute to LEED® Credit EQ-8.1. Standardized suspended ceiling components can be used to construct a sloped ceiling. However, in a sloped ceiling, conventional mounting of standard wall angles can be aesthetically and/or functionally unacceptable with a sloped ceiling at the bottom and/or top of the ceiling.

SUMMARY OF THE INVENTION

The invention provides a bracket and method of its use for adapting standard wall angle trim for use in sloped ceiling construction. The disclosed bracket arrangement can be used for the top edge or bottom edge of a sloped ceiling and be adjusted to match the angle of any practical ceiling slope. In disclosed embodiments, the bracket has the form of a rectangular flat steel sheet. The sheet has a hinge or bend line running lengthwise in its mid-area. The bend line is made by cutting the sheet intermittently along its length and thereby dividing the sheet into two sections. The cuts may be made, for example, by punching elongated slots along the bend line in a blank being formed into the bracket. Also punched into the bracket blank are a plurality of holes distributed lengthwise on marginal areas of the two sections of the blank.

The weakened hinge or bend line allows the bracket to be bent into two planes, one that aligns with a wall and one that supports the wall angle with one leg in the desired ceiling slope plane. Where the bracket is to hold a wall angle at the bottom of a slope the bracket is bent through an angle corresponding to the slope angle; where the bracket is to hold the wall angle at the top of the slope, the bracket is bent through an angle equal to 180 degrees less the sloped angle. In all cases, the attachment of the bracket to the wall is hidden from sight in the completed ceiling.

Preferably, the sections of the sheet on opposite sides of the bend line are proportioned so that when the bracket is bent or folded nearly 180 degrees, the section to be fastened to the wall is sufficiently wide such that its fastening holes are unobstructed by the other section or adjacent leg of the wall angle.

One embodiment of the invention takes the form of a simple flat rectangular plate punched with the elongated slots to form the bend line and a series of small holes for screws, pop rivets, or other fasteners to secure the bracket to a wall angle and to a wall. In another embodiment, the bracket is again stamped into a rectangular metal sheet, but includes integrally formed features proportioned to securely grip the wall angle in either condition at up or down sloped ceiling edges.

BRIEF DESCRIPTION OF THE DRAWINGS

FIG. 3 is a perspective view of the bracket used to support a wall angle at an edge of a ceiling from which it slopes upwardly;

FIG. 4 is a perspective view of the bracket used to support a wall angle at an edge of a ceiling from which it slopes downwardly;

FIG. 5 is a face view of a second embodiment of a wall angle bracket of the invention;

FIG. 6 is an edge view of the second embodiment of the bracket;

DESCRIPTION OF THE PREFERRED EMBODIMENTS

Figure 1:
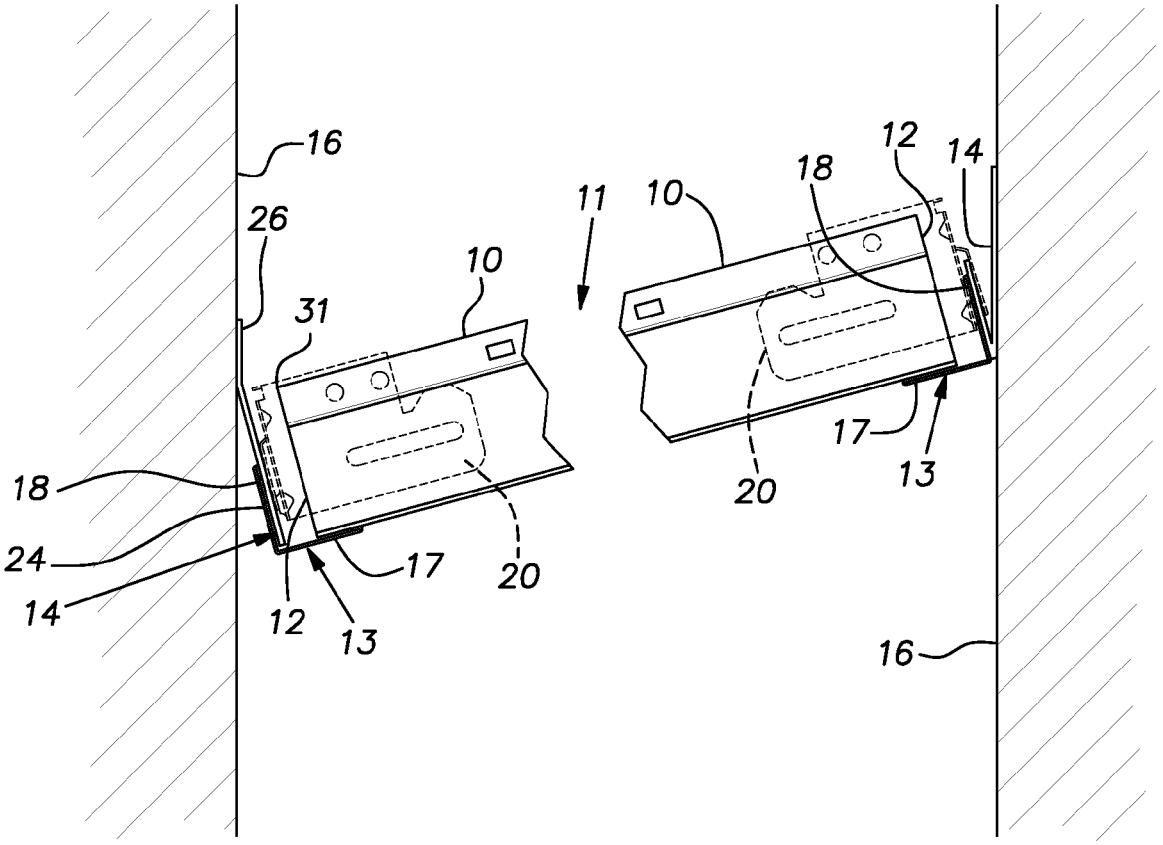
FIG. 1 is a somewhat schematic fragmentary cross-sectional elevational view of a sloped ceiling illustrating an application of the invention.

In FIG. 1, there is shown a run of main tees 10 that with other parallel main tees below and above the plane of the drawing cooperate with intervening cross tees (not shown) to form a grid of a suspended ceiling 11 in a generally conventional manner. The tees have their ends 12 supported on wall angles 13. Brackets 14 support the wall angles 13 at respective walls 16. The illustrated slope of the ceiling is 15 degrees, but it will be understood that the slope can range, say between 10 degrees and 25 degrees or even somewhat less or greater than these limits. Where required, seismic clips, known in the industry, can be used to secure the ends 12 of the tees 10 to a wall angle 13.

It is desirable that standard wall angles can be used in sloped ceiling installations so that custom fabrication of this ceiling component for the low and high edges of the ceiling is avoided. The brackets of the invention serve this purpose by supporting a standard wall angle at any angle corresponding to the slope. More specifically, the brackets support a wall angle so that its lower leg, designated 17, is parallel to the plane of the sloped ceiling.

A standard wall angle has its sides or legs 17, 18 nominally ⅞" in width and typically is supplied in 10' or 12' lengths (or metric equivalent). Main tees 10 are typically nominally 1-½" tall and it is desirable that such a dimension of the tees is accommodated at the perimeter of the ceiling, particularly at its lower edge.

Figure 2:
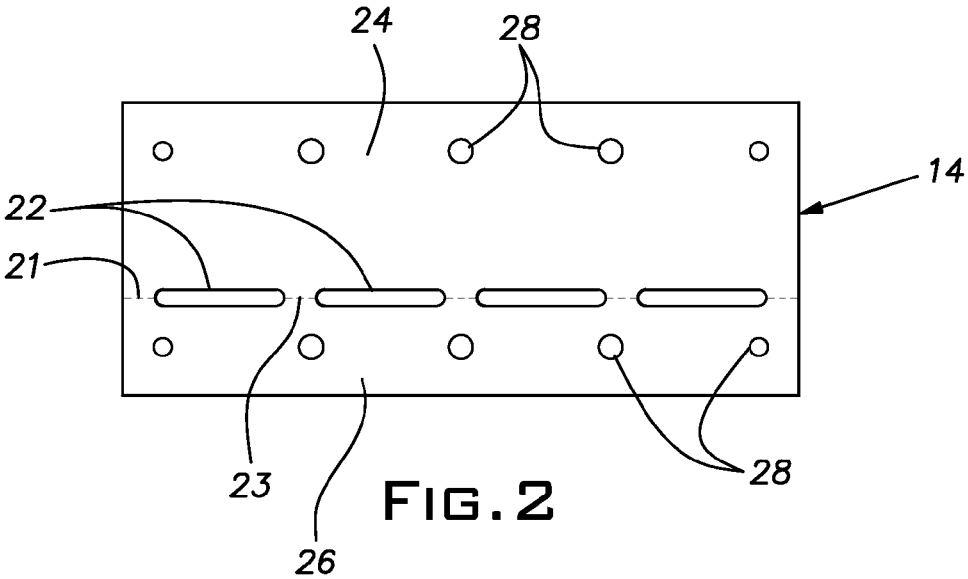
FIG. 2 is a face view of a first embodiment of a wall angle bracket constructed in accordance with the invention.

Referring in particular to FIG. 2, a first embodiment of the adjustable bracket 14 of the invention is shown. The bracket 14 is a sheet metal stamping, for example, 0.024" hot dipped galvanized, HDG G60/G40 steel in a soft condition enabling it to be bent with a permanent set. The bracket 14 has a rectangular profile and a longitudinally extending bend line 21 formed by a series of elongated intermittent slots 22 cut through its thickness. Short lands or uncut areas 23 leave the bracket 14 with adequate bending strength. The bend line 21 is offset from the longitudinal center of the bracket profile leaving major and minor sections 24, 26. Preferably, the width of the major section 24 is at least 1-½". A series of longitudinally spaced holes 28 are punched in each section 24, 26 spaced from its respective longitudinal free edge. As will be understood from the description below, the holes 28 in both sections can be used to either secure the bracket 14 to a wall 16 or to a wall angle 13.

The bracket 14 is manufactured in its illustrated flat condition. Usually at the site where a ceiling is to be erected, the bracket 14 is manually bent on the bend line 21 to permanently set the sections 24, 26 in planes that intersect one another at an angle related to the slope of the ceiling being constructed. A study of FIGS. 3 and 4 reveals that the bend is equal to the slope angle when the bracket 14 is deployed at the ceiling edge that extends upwardly. Alternatively, the bracket is bent into an angle which is substantially equal to 180 degrees minus the slope angle when it is deployed at the ceiling edge that extends downwardly (FIG. 4). In both cases, the precise angle depends on the angle of slope of the ceiling. The large bend angle at the down edge of the ceiling permits the bracket 14 to be positioned above the plane of the ceiling and therefore be mostly out of view. To minimize the view, the wall angle 13 can be mounted on the wall side of the bracket 14.

The brackets 14 can be attached to the wall angle with self-drilling screws or pop rivets. Brackets should be placed on 2' centers or less. Ordinarily, the brackets 14 can be attached to the wall angle before being attached to a wall. The fasteners can be assembled in the series of holes in the relevant section 26 or 24. In the case where the bracket 14 is used for a down edge and the manufactured holes are used to fasten the wall angle and bracket together, the bracket is secured to the wall angle before the bracket is bent to the desired angle.

As shown in FIG. 1, the major section 24 of the bracket 14 is sufficiently wide to provide clearance for the upper end, designated 31 of a standard grid tee 10 where the grid tee end abuts the wall angle 13. Additionally, as suggested in FIG. 4, the major section 24 is sufficiently wide and the holes 28 are spaced from the bend line 21 a distance at least as great as the width of the minor section 26 such that in the down edge of the ceiling application, the holes 28 are accessible to receive fasteners without obstruction by the minor section.

The minor section 26 has a width, measured from the bend line 21, about equal to the width of a side or leg 18 of the wall angle 13 and preferably not greater than this dimension.

Referring now to FIGS. 5-8, there is shown a second embodiment of an adjustable bracket 40 for use with a sloped suspended ceiling. The bracket 40 is originally formed with a generally rectangular profile and is preferably stamped from mild steel sheet stock such as described above in connection with the bracket 14. As most clearly shown in FIG. 6, the bracket 40 is generally planar except for integral features enabling it to be secured to the wall angle without separate fasteners and to stiffen it. A line of spaced elongated slots 41 cut out of the blank formed into the bracket 40 weaken the sheet to make a bend line 42. The bend line 42 separates the bracket into major and minor sections 43, 44. Holes 46 are punched in the sections 43, 44 adjacent their respective longitudinal free edges 47, 48 for purposes of attaching the bracket to a wall 16 or, optionally, a wall angle 13.

Both sections 43, 44 include a pair of rectangular tabs 51, 52 stamped or cut out of surrounding areas of the body or blank of the bracket 40 at these respective sections. Each tab 51, 52 is formed so that it lies in a plane spaced from the plane of its respective section 43, 44. The tabs 51, 52 remain attached to their respective sections 43, 44 with a web 53, 54 as shown in FIG. 6.

Associated with each tab 51 or 52 is a catch or hook 56 stamped into the body of the tab. The catches 56 include edges 57 that project above the plane of the surrounding material of the tab and ramp or cam surfaces 58 from the plane of the surrounding tab material to the edge 57.

A stiffening rib 59 parallel to the longitudinal direction of the bracket 40 is stamped into each section 43, 44. The ribs help keep the sections 43, 44 flat when the sections are bent relative to one another on the bend line 42.

The bracket 40, like the previously described bracket 14, is permanently bent on the bend line 42 to suit the slope of the ceiling. As in the case of the earlier described bracket 14, this can be done manually in the field, i.e. at the building construction site.

Figure 7:
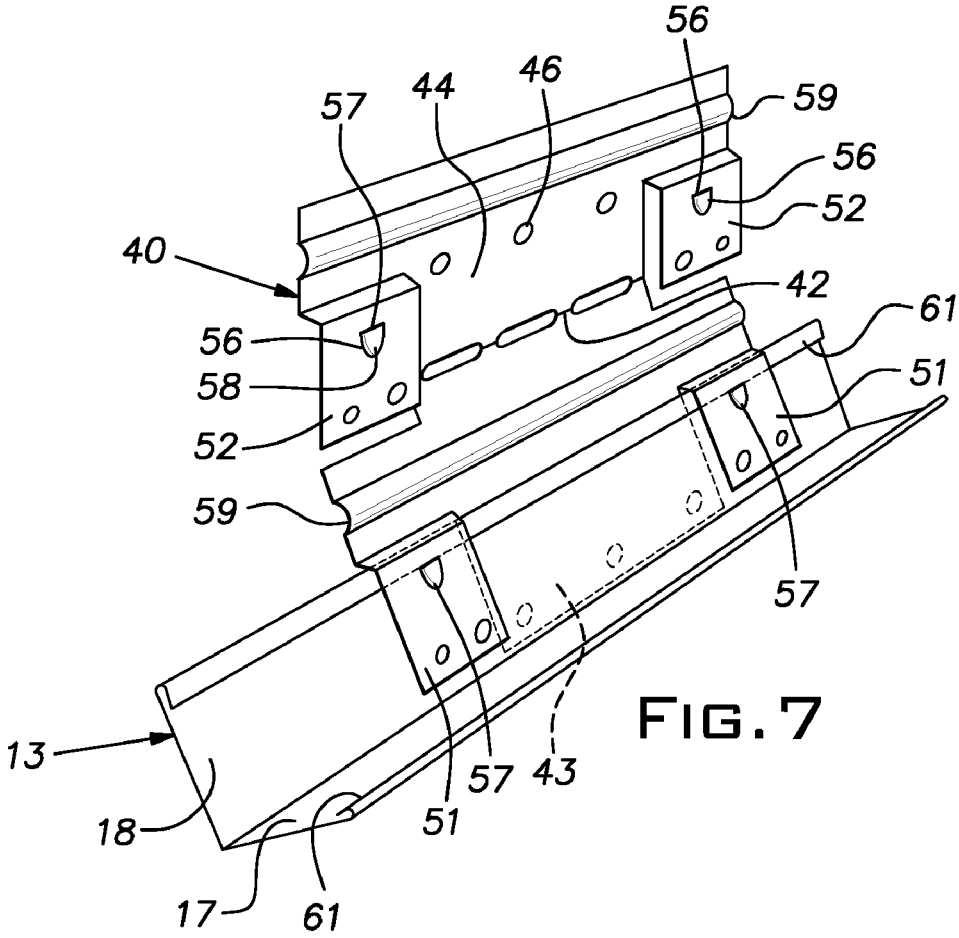
FIG. 7 is a perspective view of the second embodiment bracket used to support a wall angle at the edge of a ceiling from which it slopes upwardly.
Figure 8:
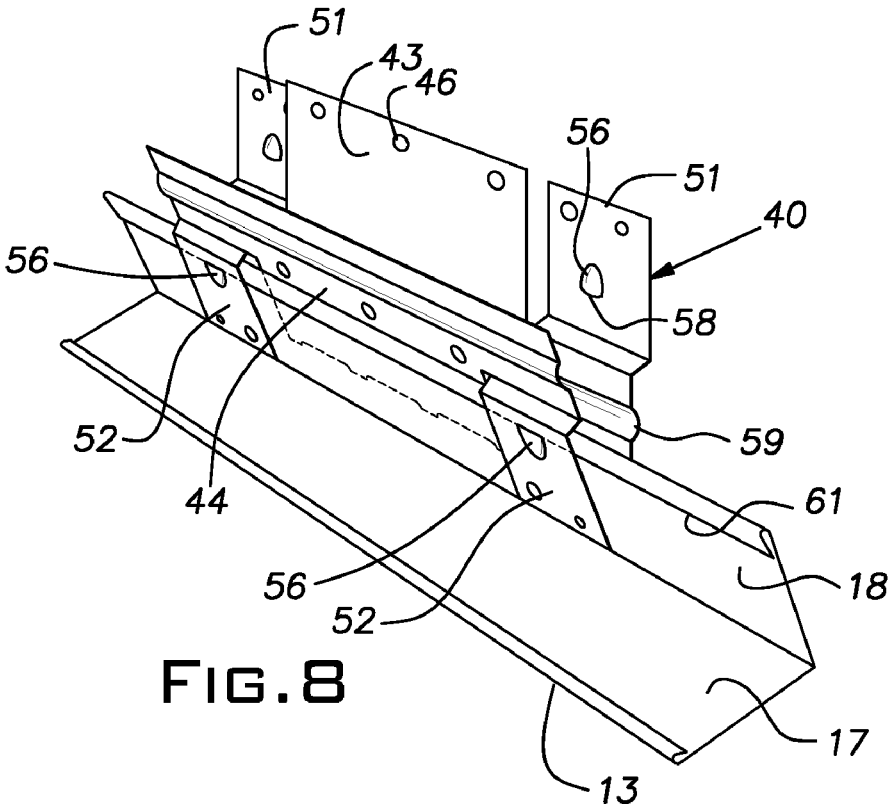
FIG. 8 is a perspective view of the second embodiment bracket used to support a wall angle at the edge of a ceiling from which it slopes downwardly.

Referring to FIG. 7, for ceiling edges sloping up, the bracket 40 is bent through an angle equal to the slope. The major section 43 is secured to a wall angle 13 by inserting the upstanding leg 18 of the wall angle between the main part of the major section 43 and the tabs 51. The catches 56, due to the wedge-like shape of the ramp area 58 slide over and trap a hem 61 along the longitudinal edge of the wall angle leg 18 thereby effectively securing the bracket 40 to the wall angle. It should be noted that the bracket 40 can be shifted along the wall angle to adjust its position to match the wall construction. The bracket 40 can be locked in place on the wall angle by a screw in any one of the holes 46 associated with the major section 43.

Like the bracket 14, for ceiling edges that slope down, the bracket 40 is bent 180 degrees less the slope angle. The bracket 40 is secured to the wall angle by slipping the upper leg 18 of the wall angle between the tabs 52 and the main part of the minor section 44. The catches 56 retain the bracket 40 on the wall angle 13 by snapping over and locking on the hem 61. The major section 43 is secured to a wall with screws or other fasteners assembled through the holes 46. Prior to assembly to the wall, the bracket 40 can be shifted lengthwise of the wall angle 13 while it is secured thereto by the catches 56.

Brackets 14 or 40 can be mounted to the wall 16 somewhere between the main runners or tees 10 of the ceiling 11 to allow ease of assembly of seismic clips, shown in phantom at 20 in FIG. 1, on the ends of the main runners if required. Where the ceiling slope angle is relatively large and a gap exists between the wall angle 12 and the wall 16 at the down ceiling edge, with either bracket 14 or 40, an additional wall angle can be attached against the wall in a normal manner to conceal the gap. This can be done first and the brackets 14 or 40 with the tilted wall angle can be installed on top of the first wall angle.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. In combination, a suspended ceiling wall angle and a bracket made of sheet metal, the bracket attached to the ceiling wall angle and to a wall such that the wall angle is attached to the wall via the bracket at an angle corresponding to a slope of a ceiling, wherein a generally triangular gap is created between the wall and the bracket, the bracket being stamped with a generally rectangular profile and a generally flat configuration, the bracket including a bend line along the bracket's longitudinal direction in a mid-zone of the profile that divides the bracket into major and minor sections, the bend line being formed by a weakened area in the sheet metal, such that when the bracket is bent at the bend line the major and minor sections are oriented in different planes that intersect at the bend line with an angle determined by the slope of the ceiling, and a plurality of screw receiving holes in each of said major and minor sections for attaching the bracket to the ceiling wall angle or the wall, the bracket including a pair of integral cantilevered ceiling wall angle engaging tabs on each of said major and minor sections, both tabs of each pair of tabs of each of said major and minor sections extending in a common direction generally parallel to a plane of the respective major or minor section and away from a respective web of attachment with the respective major or minor section, the webs of attachments of both tabs of each pair of tabs lying in and along a common line parallel to the bend line.

2. The combination set forth in claim 1, wherein the weakened area is made by interrupted cuts through the sheet metal forming the bracket.

3. The combination set forth in claim 2, wherein the cuts form elongated slots through the sheet metal forming the bracket.

4. The combination as set forth in claim 1, wherein said major and minor sections include catches for gripping a hem on a longitudinal edge of a leg of a roll formed sheet metal wall angle.

5. The combination as set forth in claim 1, wherein the plurality of holes on the major section are unobstructed by the minor section when the minor section is bent on the bend line to an angle of 180 degrees.

6. A method of facilitating the mounting of a wall angle for a sloped suspended ceiling comprising the steps of:

providing a wall angle, stamping a bracket made of sheet metal with a rectangular profile;

forming a bend line extending lengthwise through a mid-portion of the profile of the bracket by weakening the sheet metal the along the bend line;

bending the bracket at the bend line to create a first and second section on opposite sides of the bend line oriented in different planes that intersect at the bend line with an angle determined by the slope of a ceiling;

providing the bracket such that the first section is at least as wide as the height of a grid tee and the second section on a side of the bend line opposite said first section has the width of a leg of the wall angle, stamping a pair of cantilevered wall angle engaging tabs on each of said first and second sections such that each tab of each pair of tabs on both the first and second section extend in a common direction generally parallel to the respective first or second section from webs of attachment on respective first and second sections, punching holes in both said first and second section, disposing screw fasteners in said holes to attach the bracket to the leg of the wall angle such that the wall angle is attached to the wall via the bracket at an angle corresponding to the slope of the ceiling such that a generally triangular gap is created between said wall and said bracket, wherein the bracket can be distributed in a planar condition to enable an installer to bend the bracket on site.

* * * * *